US010605076B2

(12) United States Patent
Odegbami et al.

(10) Patent No.: US 10,605,076 B2
(45) Date of Patent: Mar. 31, 2020

(54) HIGH AMPLITUDE PULSE GENERATOR FOR DOWN-HOLE TOOLS

(71) Applicant: Halliburton Energy Services, Inc., Houston, TX (US)

(72) Inventors: Olumide O. Odegbami, Houston, TX (US); Larry DeLynn Chambers, Kingwood, TX (US); Daniel Patrick Carter, Montgomery, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/311,541

(22) PCT Filed: Jul. 6, 2016

(86) PCT No.: PCT/US2016/041100
§ 371 (c)(1),
(2) Date: Dec. 19, 2018

(87) PCT Pub. No.: WO2018/009183
PCT Pub. Date: Jan. 11, 2018

(65) Prior Publication Data
US 2019/0203592 A1 Jul. 4, 2019

(51) Int. Cl.
*E21B 47/18* (2012.01)
*E21B 21/08* (2006.01)

(52) U.S. Cl.
CPC ..... *E21B 47/185* (2013.01); *E21B 21/08* (2013.01); *E21B 47/182* (2013.01); *E21B 47/187* (2013.01)

(58) Field of Classification Search
CPC ..... E21B 47/185; E21B 21/08; E21B 47/182; E21B 47/187
USPC ..... 340/83; 367/83
See application file for complete search history.

(56) References Cited

U.S. PATENT DOCUMENTS 4,703,461 A 10/1987 Kotlyar
4,771,408 A 9/1988 Kotlyar
4,785,300 A * 11/1988 Chin ..... E21B 47/18 137/499
4,953,595 A 9/1990 Kotlyar
5,583,827 A * 12/1996 Chin ..... E21B 47/18 175/40
5,787,052 A * 7/1998 Gardner ..... E21B 47/18 175/48
6,714,138 B1 * 3/2004 Turner ..... E21B 47/18 340/854.3

(Continued)

FOREIGN PATENT DOCUMENTS

CA 2435790 A1 8/2002

OTHER PUBLICATIONS

Patent Cooperation Treaty, International Search Report and Written Opinion, PCT Appln. No. PCT/US2016/041100, dated Mar. 14, 2017.

*Primary Examiner* — Zhen Y Wu
(74) *Attorney, Agent, or Firm* — McGuireWoods, LLP

(57) ABSTRACT

Well systems comprise communicating devices for use in subterranean formations. An example well system comprises a mud valve system having a stator and a rotor to modulate drilling mud flow to provide increased pulse amplitude signals up-hole for improved and faster signaling from down-hole tools while also providing for better detection capability up-hole. The improved signaling technique permits for deeper well applications.

18 Claims, 4 Drawing Sheets

(56) References Cited

U.S. PATENT DOCUMENTS

| | | | | |
|---|---|---|---|---|
| 7,250,873 | B2 * | 7/2007 | Hahn | E21B 47/18 340/853.1 |
| 8,174,404 | B2 * | 5/2012 | Hahn | E21B 47/18 340/854.3 |
| 2004/0012500 | A1 * | 1/2004 | Hahn | E21B 47/18 340/854.4 |
| 2008/0055110 | A1 * | 3/2008 | Hahn | E21B 47/18 340/854.3 |
| 2010/0157735 | A1 * | 6/2010 | Allan | E21B 47/187 367/84 |
| 2010/0230113 | A1 * | 9/2010 | Hutin | E21B 47/182 166/373 |
| 2012/0127829 | A1 * | 5/2012 | Sitka | E21B 47/185 367/83 |
| 2013/0277119 | A1 * | 10/2013 | Rogers | E21B 21/10 175/317 |
| 2015/0275660 | A1 * | 10/2015 | Logan | E21B 47/06 175/48 |
| 2016/0215615 | A1 * | 7/2016 | Gorrara | E21B 47/18 |
| 2017/0234073 | A1 * | 8/2017 | Nguyen | E21B 7/24 175/40 |
| 2018/0045035 | A1 * | 2/2018 | Logan | E21B 47/09 |

* cited by examiner

HIGH AMPLITUDE PULSE GENERATOR FOR DOWN-HOLE TOOLS

This is a 371 national stage application of International Patent Application No. PCT/US2016/041100 filed Jul. 6, 2016, the disclosure of which is incorporated by reference herein in its entirety.

TECHNICAL FIELD

The present disclosure relates to downhole tools for use in a wellbore environment and, more particularly, to an apparatus for transmitting signals from the bottom of a wellbore to the surface that includes generating pressure pulses within the hydraulic flow in the drill string, and which may be used at deep well depths.

BACKGROUND

In a well completion, logging while drilling (LWD) and monitoring while drilling (MWD) real time data needs to be communicated up-hole to assist in making various drilling decisions to accomplish well production. One technique to communicate includes mud pulse telemetry. One of the challenges of mud pulse telemetry is up-hole data detection, which may be affected by a variety of factors including well depth, bore hole size, noise from pumps, power systems and well as type of drilling mud employed.

Increasing data rates as well as permitting increased up-hole detection of pressure signals provides for more reliable real-time control data from down-hole tools. Moreover, increasing the depth at which the telemetry may effectively communicate permits deeper well applications.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates to a mud valve system for transmitting signals such as telemetry signals from the bottom of a wellbore to the surface that includes generating pressure pulses within the hydraulic flow in the drill string which may be used at substantial well depths, such as, e.g., up to about 9000 m, or more.

Figure 1:
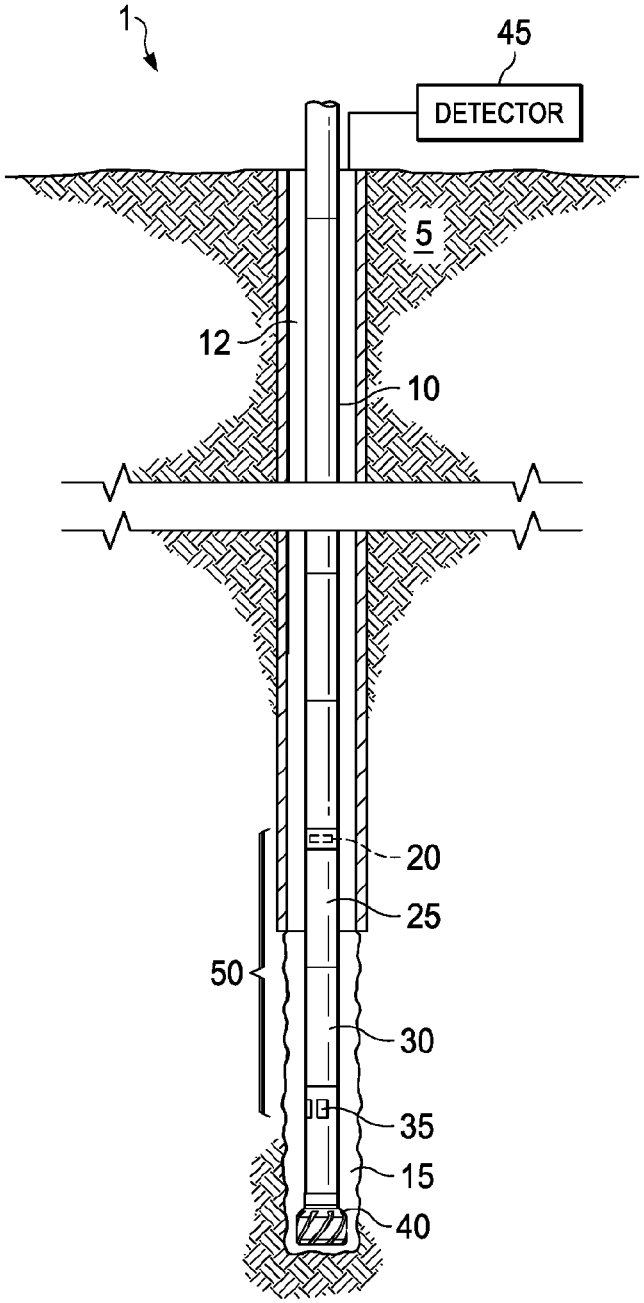
FIG. 1 is an illustration of a system for logging while drilling (LWD) and/or monitoring while drilling (MWD), configured according to principles of the disclosure.

FIG. 1 is an illustration of a system 1 for logging while drilling (LWD) and/or monitoring while drilling (MWD) that includes well strings 10 in a formation 5 that drives a well bit 40 and may also include a data signaling unit 50 that may be placed in well string 10 for use in conveying telemetry up-hole to a detector 45. The data signaling unit 50 may include a mud valve system 20, a power source 25, a data encoder 30, and at least one measuring device 35, which are operatively interconnected. The power source 25 may comprise a battery, a mud turbine, or similar powering device for powering downhole electronic devices. The detector 45 may include transducers for receiving positive or negative pulses of pressure within the drill string 10 or wellbore. Other embodiments of the system 1 may include additional or different down-hole tools, perhaps at different positions within or proximate the well string 10. The measuring device 35 may comprise nearly any down-hole tool that requires or needs to communicate up-hole to detector 45. One of the at least one measuring devices 35 may also receive control signals from the surface for controlling the mud valve system 20.

Telemetry signaling involves encoding of data from one or more measuring devices 35 into sequences of pressure pulses that propagate up the circulating fluid medium, commonly referred to as drilling mud. The pulses generally are created by a mud valve system 20 by either restricting flow of the drilling mud momentarily to provide a positive pulse up-hole toward the surface, or bypassing some of the drilling mud flow from the well string 10 to the annulus 12 or the borehole 15, to create a negative pressure pulse up-hole propagating toward the surface.

Figure 2A:
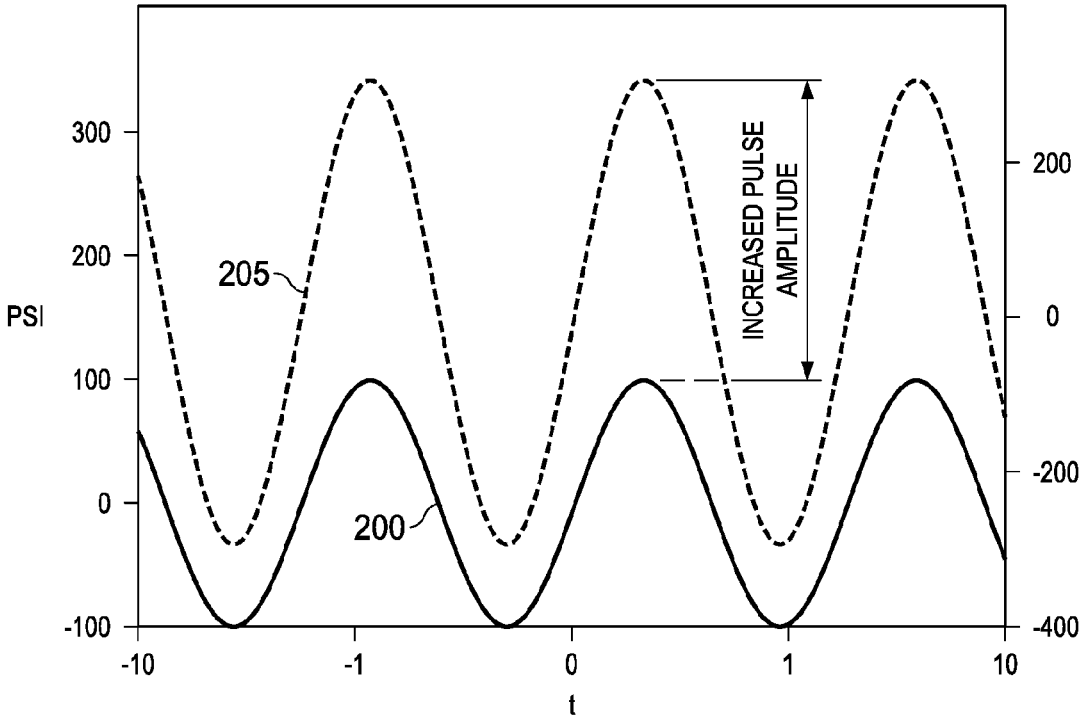
FIG. 2A is a graph showing increased pulse amplitude generated down-hole by a mud valve system, configured according to principles of the disclosure.
Figure 2B:
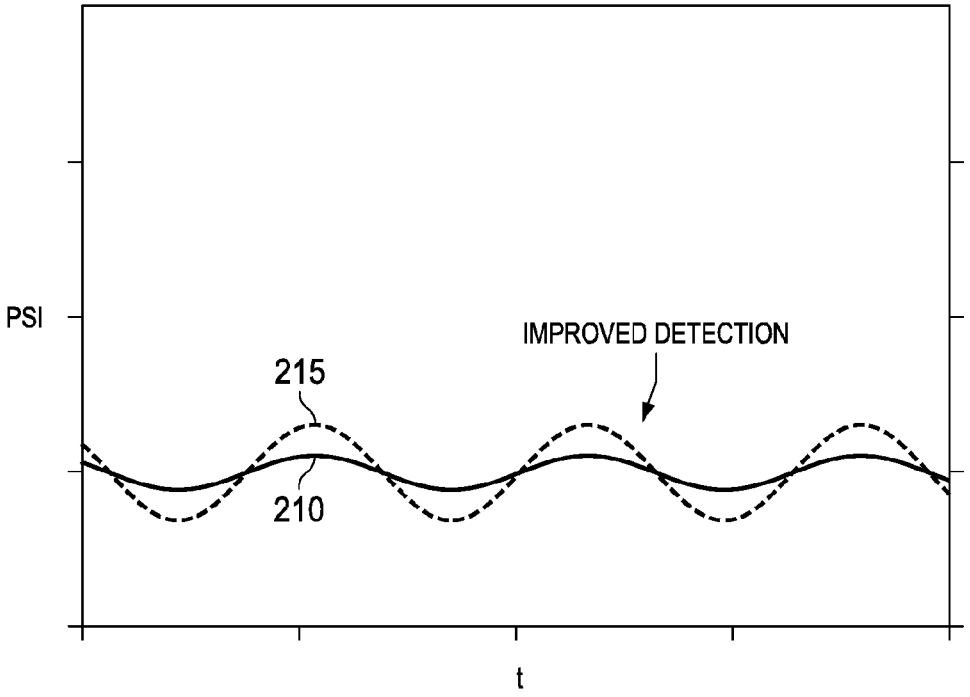
FIG. 2B is a graph showing increased pulse amplitude received up-hole from a mud valve system, configured according to principles of the disclosure.

FIG. 2A is a graph showing relative increased pulse amplitude 205 created by mud valve system 20, as compared with typical pulse amplitudes 200 traditionally available. FIG. 2B is a graph showing relative received increased pulse amplitude 215 of a signal from mud valve system 20 as detected by detector 45 at the surface, as compared with typical signals 210 traditionally available. The increased pulse amplitude 205 created by mud valve system 20 permits more reliable communication at deeper depths. Moreover, the increased pulse amplitude 205 provides for increased signal rates resulting in faster real-time data transfer up-hole. The values shown in FIG. 2A are illustrative only and may be other values.

Figure 3:
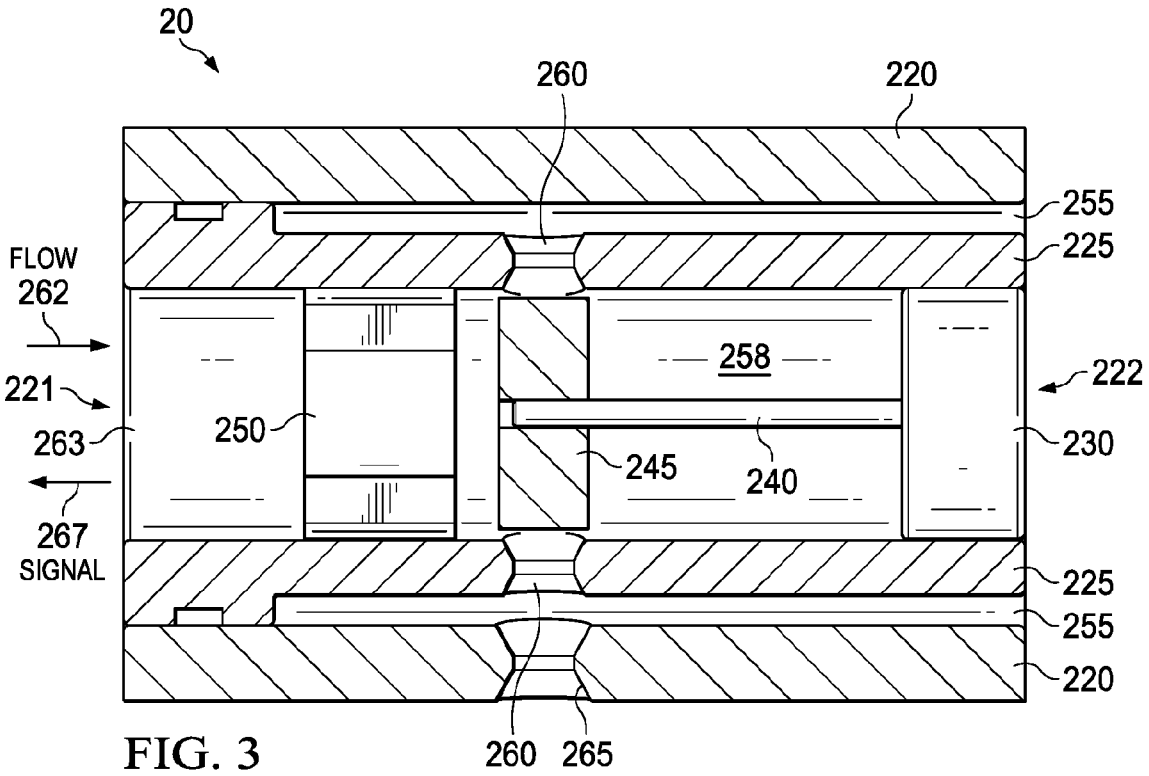
FIG. 3 is a cross-sectional view of a mud valve system, configured according to principles of the disclosure.

FIG. 3 is a cross-sectional view of a mud valve system 20, configured according to principles of the disclosure. The mud valve system 20 may comprise a first end 221 and a second end 222. The mud valve system 20 may comprise an outer housing body 220, an inner housing body 225, and a flow channel 255 formed therebetween. A plurality of vent ports 260 interconnect the interior 258 of the mud valve system 20, proximate the rotor 245, with the flow channel 255. The plurality of vent ports 260 are located at equally spaced locations around the circumference of the inner housing body 225, along a common plane.

The outer housing body 220 and the inner housing body 225 are generally circular in shape, but are not necessarily limited to this shape. The flow channel 255 formed between the outer housing body 220 and the inner housing body 225 may extend at least from the plurality of vent ports 260 to the second end 222 of the mud valve system 20. The flow channel 255 may extend towards the first end 221, such as past the stator 250. The flow channel 255 permits drilling mud fluid to continue to flow down-hole as permitted by the rotor 245 position relative to the vent ports 260, as explained more fully below. One or more vent ports 265 may be configured in the outer housing body 220 to also permit flow of drilling mud into the annulus 12; the flow is also regulated by rotor 245. The one or more vent ports 265 are typically aligned and adjacent with a respective at least one vent port 260. The one or more vent ports 265 are in fluid communication with at least one of the plurality of vent ports 260.

The one or more vent ports 265 located in the outer housing body is in fluid communication with an annulus 12. The one or more vent ports 265 aid in releasing drilling mud fluid into the annulus 12 of the well to decrease wear or damage to the outer housing body 220. In this way, the one or more vent ports 265 vent off a portion of drilling mud pressure and also act as a sacrificial feature that bears most of the wear of drilling mud pressure within the outer housing body 255 of the mud valve system 20, instead of permitting the drilling mud to wear along the length of the outer housing body 255 at a higher pressure. The one or more vent ports 265 may be replaced as required as a maintenance activity.

A stator 250 may be positioned and held in place within the inner housing body 225 adjacent to a rotor 245. The rotor may be driven by a shaft 240 that is connected to a drive unit 230 for rotating the rotor at a selected rate. The rate may be variable and under control of operators at the surface. Communication with down-hole devices from the surface and operators is a known technique in the art, and is not shown. The drive unit 230 may be coupled to and powered by power source 25.

As mud flows (or is diverted) into the mud valve system 20 at the first end 221 and is straightened as shown by arrow 262, the mud encounters the stator 250. Depending on the position of the rotors 245, the drilling mud may be substantially blocked causing momentary build-up of mud fluid pressure proximate the first end 263 of the mud valve system 20. This mud fluid pressure build-up is propagated as a pulse up-hole towards the surface as indicated as signal 267 to be received by detector 45. However, as the rotor 245 rotates within the inner housing body 225, a plurality of channels are momentarily opened permitting fluid to flow from the first end 263 through a plurality of channels in the stator 250 into one or more of the vent ports 260 onward to the wellbore and annulus 12. Overall, the effect is creation of increased pulse amplitude signals.

Figure 5:
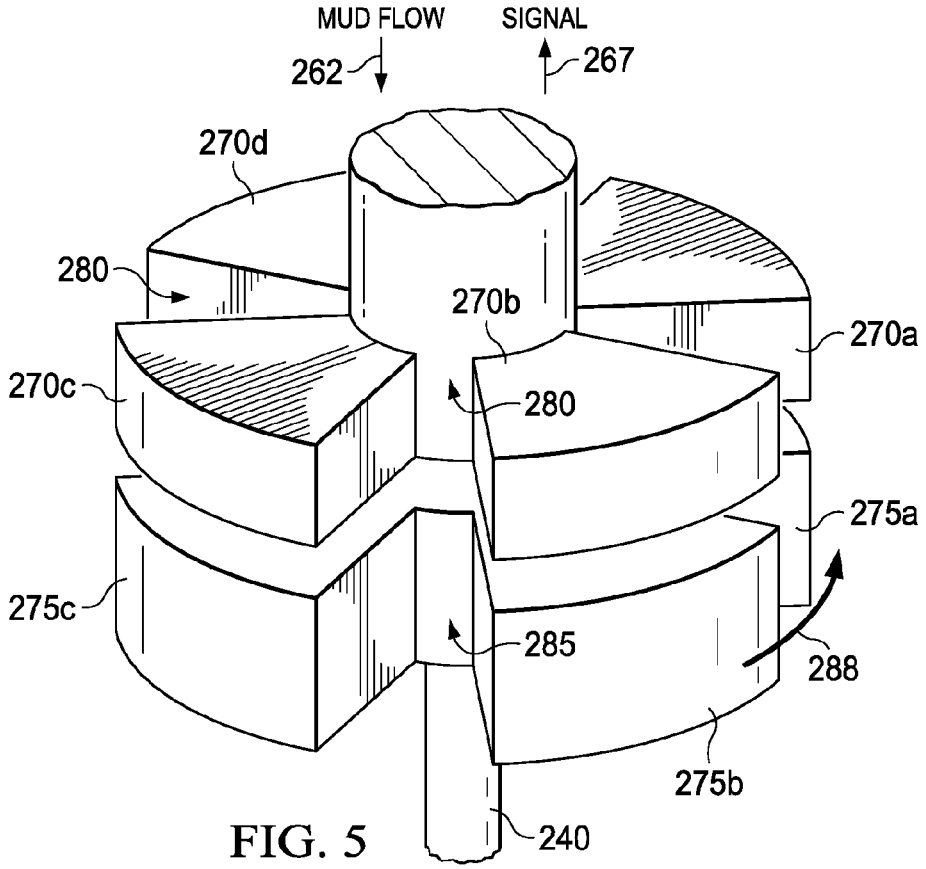
FIG. 5 is an example illustration of stator lobes and rotor lobes, configured according to principles of the disclosure.
Figure 4A:
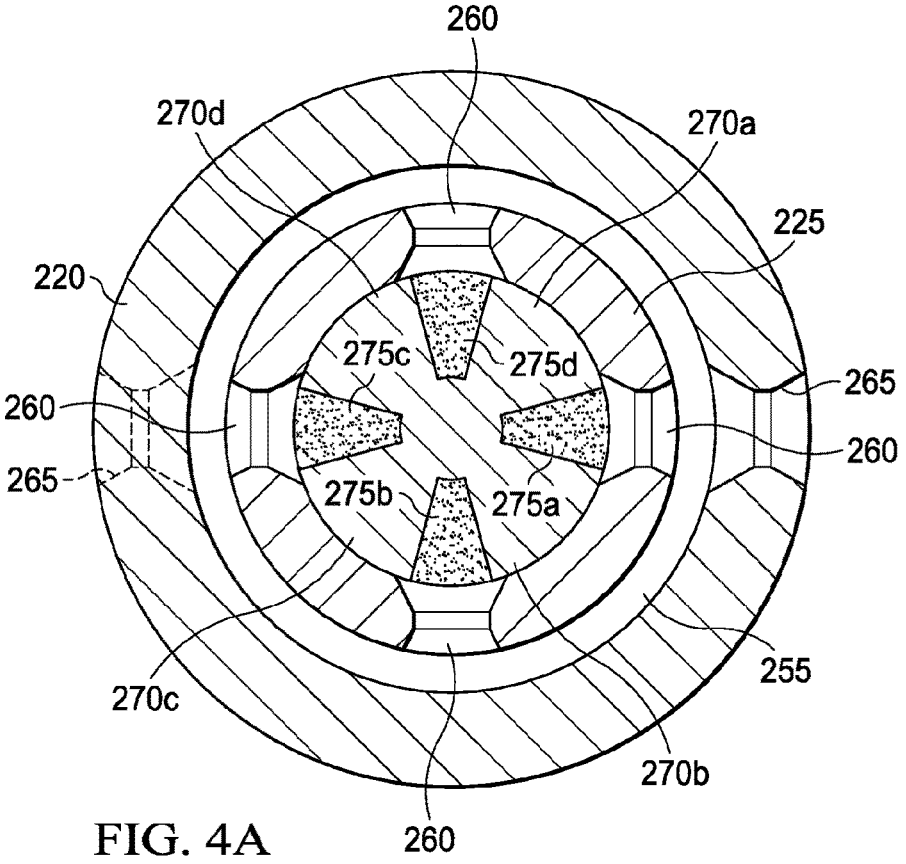
FIG. 4A is a cross-sectional view of a configuration of stator lobes relative to rotor lobes, shown in a closed position to block flow of drilling mud, configured according to principles of the disclosure.

FIG. 4A illustrates the relationship of the stator lobes 270*a*-270*d* and the rotor lobes 275*a*-275*d*, in a closed position. The stator lobes 270*a*-270*d* are fixed within the inner housing body 25, so as to prevent movement. There are a plurality of stator channels 280 (FIG. 5) formed between each pair of stator lobes 270*a*-270*d*. The number of stator channels 280 is related to the number of stator lobes employed, which may vary in different embodiments. The rotor 245 is positioned adjacent to the stator 250 in a close mating position to prevent significant drilling mud leakage between them, while in a closed position, although some leakage might occur. The rotor 245 has a plurality of rotor channels 285 formed between pairs of rotor lobes 270*a*-270*d* (FIG. 5). The number of rotor channels 285 may vary in different embodiments, but are typically the same number as stator channels 280. In the position as shown in FIG. 4A, the rotor lobes 270*a*-270*d* block or restrict the flow of mud through the mud valve system 20, substantially restricting the drilling mud flow from exiting out the plurality of vent ports 260. This causes momentary pressure build-up at the mud valve system 20 which is propagated up-hole for detection at detector 45.

Figure 4B:
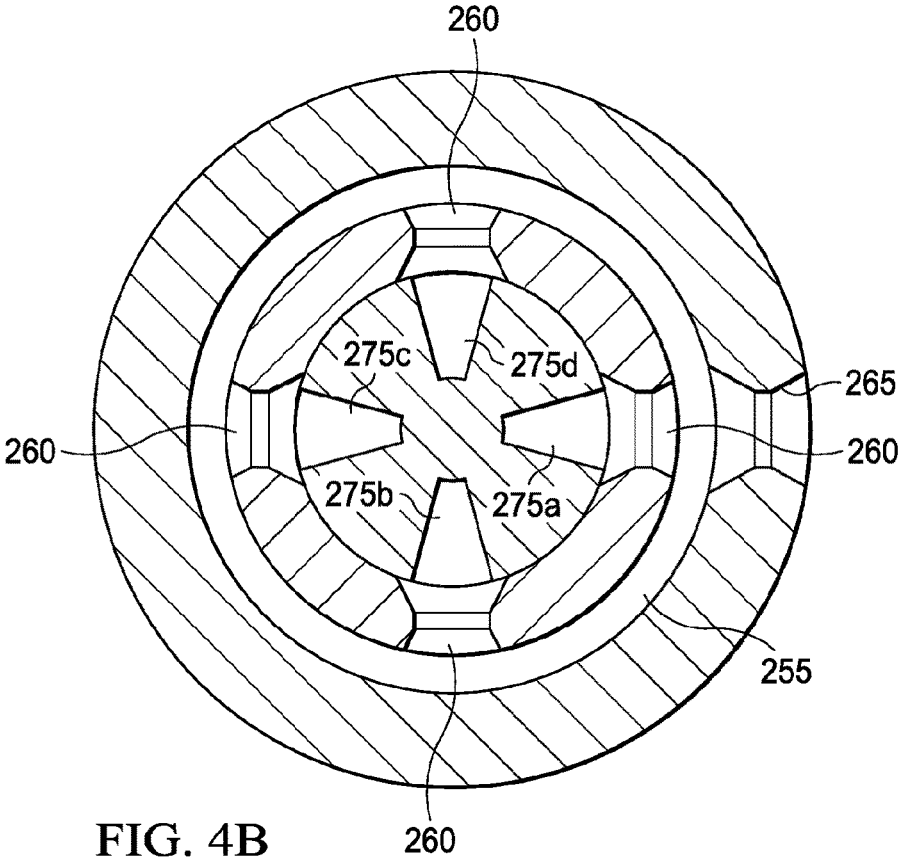
FIG. 4B is a cross-sectional view of a configuration of stator lobes relative to a rotor lobes, shown in an open position to permit flow of drilling mud, configured according to principles of the disclosure.

FIG. 4B illustrates the relationship of the stator lobes 270*a*-270*d* and the rotor lobes 275*a*-275*d*, in an opened position. The rotor lobes 270*a*-270*d* are now shown positioned to permit or increase flow of drilling mud through the mud valve system 20, and allows or increases the drilling mud flow through stator channels 280 and rotor channels 285 and exit out the plurality of vents 260. This opened position causes a momentary pressure drop which is propagated up-hole as a signal 267 for detection at detector 45 as a negative pressure. When the rotor is in a fully opened position, the plurality of rotor channels 285 align with the plurality of stator channels 280 and also align with the plurality of vent ports 260, providing a plurality of completed passageways for drilling mud to flow through the mud valve system 20. The plurality of vent ports 260 are considered to be out-of-phase with the stator lobes 270*a*-270*d*. The plurality of rotor channels 285 provide the mechanism to bring the plurality of vent ports in-phase with the plurality of stator channels 280, in an open position.

FIG. 5 is an example illustration of a plurality of lobes 270*a*-270*d* which may be configured as part of the stator 250, in relation to the plurality of lobes 275*a*-275*d* of the rotor 245, configured according to principles of the disclosure. The lobes 270*a*-270*d* of the stator 250 are fixed within the inner housing body 225, and do not turn. The lobes 275*a*-275*d* of the rotor can rotate at a variable controlled rate, such as controlled by an operator at the surface. As the lobes 275*a*-275*d* of the rotor 245 rotate, a plurality of completed or continuous passageways are created through a plurality of stator channels 280 through the plurality of rotor channels 285 and through one or more ports 260 in the inner housing body 225 permitting drilling mud to flow down-hole through the channel 255, and into the annulus 12 through port 265.

Figure 6:
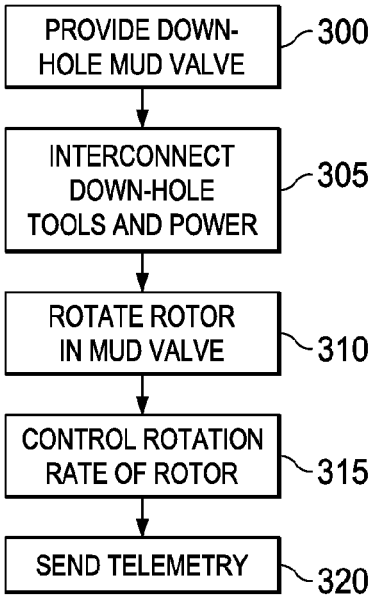
FIG. 6 is a flow diagram of an example process, the process performed according to principles of the disclosure.

FIG. 6 is a flow diagram of a process of using the mud valve system 20, the process performed according to principles of the disclosure. At step 300 a mud valve system 20 may be provided down-hole within a well string 10. At step 305, the mud valve system 20 may be operatively connected to a power source 25 and to one or more monitoring or measuring devices 35, or other down-hole tools. Moreover, an encoder 30 may be coupled to the mud valve system for encoding data from the measuring devices 35 for transmission by the mud valve system 20 to detector 45. The mud valve system 20 may be under control of surface operators. At step 310, the rotor 245 of the mud valve system 20 may be rotated by a drive unit 230 at a desired rate. The rate may be selected based on depth of the well, type of mud fluid, conditions in the well, or other factors known to the operators at the surface. Rotating the rotor 245 in the valve 20 at a desired rate to a first position blocks flow of drilling mud from flowing down-hole, the first position causing an increased positive pulse amplitude signal up-hole for signaling. Rotating the rotor 245 in the valve 20 at a desired rate to a second position permits drilling mud to flow down-hole in the wellbore, the second position causing an increased negative pulse amplitude signal up-hole for signaling. The rotation of the rotor 245 to a closed position, or first position, causes temporary pressure build-up of the mud fluid at the mud valve system 20 which is detectable as an increased positive pulse amplitude signal by detector 45. As the rotor 245 rotates to an opened position, or second position, a significant drilling mud flow occurs down-hole and into the annulus 12 that results in increased negative pulse amplitude signal in an up-hole direction detectable by detector 45. Repeating rotation of the rotor 245 from a first position to a second position and back to a first position, etc., provides a technique for up-hole real-time signaling by causing a plurality of an increased pulse amplitude signals.

At step 315, the rotation rate of the rotor may be controlled to provide an optimal signal for detection by an up-hole detector. The desired rate of rotation may be dependent on, e.g., well conditions, such as depth, type of drilling mud, or other factors. The speed of the drive unit 230 controls the rotation rate of the rotor 245 and may be selected by an operator at the surface.

At step 320, an encode signal may be sent by the mud valve system. The receiver 45 may receive the signal.

Downhole tools may utilize the telemetry signaling capability of the mud valve system 20 to have encoded messages sent up-hole for reporting on various measured parameters and conditions of the down-hole environment. The unique configuration of mud valve system 20 provides a means of increasing real time data rate by modulating negative and positive signals. The mud valve system 20 also provides a means to achieve higher pulse amplitude, i.e., a signal to be measured up-hole, which increases an ability of up-hole detection of the modulated pressure signals.

The stator lobes 270*a*-270*d* and plurality of vent ports 260 are configured to be out of phase thus creating larger bore pressure when the mud valve system is closed and venting a larger volume of drilling mud when the mud valve system is opened. Venting drilling mud into the channel 255 along the outer housing body 220 and inner housing body 225, such as into flow channel 255, rather than a mud valve system collar avoids collar wash-out/erosion.

The mud valve system 20 provides advantages including increased data rates by means of modulating positive and negative valves 180 degrees out of phase. The rotor 245 provides for fully rotational or oscillatory motion. The mud valve system 20 provides for, e.g., increased or improved signal detection in more complicated drilling scenarios, controllable increased data rates, and signaling from deeper wells. The mud valve system 20 permits encoding of messages from one or more down-hole tools and measuring devices for transmission to a detector 45 at or proximate the surface. The increased pulse amplitudes generated by the mud valve system 20 permits for higher real time data rates and more easily detectable messages at the surface.

Various features of the disclosure include:

Clause 1. A mud valve system for creating increased pulse amplitude signals in a wellbore, comprising:

an inner housing body having a plurality of vent ports formed therein and configured to direct drilling mud flow to a stator;

an outer housing body enveloping the inner housing body and forming a flow channel therebetween;

the stator having a plurality of stator lobes forming a plurality of stator channels therebetween; and a rotor positioned adjacent the stator and having a plurality of rotor lobes forming a plurality of rotor channels therebetween, the rotor rotatable from a closed position to an open position and from the open position to the closed position relative to the stator, the closed position restricting drilling mud flow from the plurality of stator channels to the plurality of vent ports creating an increased positive pulse amplitude signal up-hole, and the open position increasing drilling mud flow from the plurality of stator channels through the plurality of rotor channels to the plurality of vent ports into the flow channel creating an increased negative pulse amplitude signal up-hole, for communicating data from at least one down-hole device.

Clause 2. The mud valve system of clause 1, further comprising at least one vent port configured in the outer housing body and is in fluid communication with at least one of the plurality of vent ports in the inner housing.

Clause 3. The mud valve system of clause 2, wherein the at least one vent port configured in the outer housing body is in fluid communication with an annulus.

Clause 4. The mud valve system of clauses 2 or 3, wherein the at least one vent port configured in the outer housing body is replaceable.

Clause 5. The mud valve system of clauses 1, 2, 3 or 4, wherein a total amount of stator channels is the same as a total amount of rotor channels.

Clause 6. The mud valve system of any one of clauses 1-5, further comprising a drive unit to rotate the rotor.

Clause 7. The mud valve system of any one of clauses 1-6, wherein the drive unit is controllable to select a rotation rate of the rotor for selecting a data rate.

Clause 8. The mud valve system of any one of clauses 1-7, wherein the mud valve system is operatively connectable to the at least one down-hole device for permitting the at least one down-hole device to communicate up-hole using the mud valve.

Clause 9. The mud valve system of any one of clauses 1-8, wherein the increased positive pulse amplitude signal and the increased negative pulse amplitude signal provides for improved detection ability at a receiver up-hole.

Clause 10. The mud valve system of any one of clauses 1-9, wherein the flow channel is in fluid connection with each of the plurality of vent ports in the inner housing for conveying drilling mud down-hole.

Clause 11. A method for creating increased pulse amplitude signals in a wellbore, comprising:

rotating a rotor in a valve at a desired rate to a first position to restrict flow of drilling mud down-hole, the first position causing an increased positive pulse amplitude signal up-hole for signaling; and rotating a rotor in the valve at a desired rate to a second position to increase drilling mud to flow down-hole, the second position causing an increased negative pulse amplitude signal up-hole for signaling.

Clause 12. The method of clause 11, wherein the step of rotating rotates the rotor to the second position permitting a plurality of channels formed in the rotor to align with a plurality of channels formed in a stator within the valve.

Clause 13. The method of clause 12, wherein the step of rotating rotates the rotor to the second position increasing drilling mud flow down-hole and into an annulus.

Clause 14. The method of clause 11, wherein the step of rotating rotates the rotor to the first position permitting a plurality of lobes formed in the rotor to block flow of the drilling mud from flowing through a plurality of channels formed in the stator.

Clause 15. The method of any of clauses 11-14, further comprising alternating rotating the rotor from the first position to the second position to create a plurality of increased pulse amplitude for communicating up-hole.

Clause 16. The method of any of clauses 11-15, further comprising controlling a rotation rate of the rotor to provide an optimal signal for detection by a detector up-hole.

Clause 17. The method of any of clauses 11-16, wherein the rotating steps generate the increased positive pulse amplitude signal and the increased negative pulse amplitude signal that are detectable up to at least 9000 meters of well depth.

Clause 18. The method of clause 11, further comprising venting a portion of the drilling fluid into an annulus, while the rotor is in a second position.

Clause 19. The method of clause 11, wherein the first position causes a momentary buildup of pressure detectable up-hole as the increased positive pulse amplitude signal.

Clause 20. The method of clause 11, wherein the second position causes a momentary reduction of pressure detectable up-hole as the increased negative pulse amplitude signal.

Clause 21. A mud valve system for creating increased pulse amplitude signals in a wellbore, comprising:

a stator having a plurality of stator lobes forming a plurality of stator channels therebetween; and a rotor positioned adjacent the stator and having a plurality of rotor lobes forming a plurality of rotor channels therebetween, the rotor rotatable from a closed position to an open position and from the open position to the closed position relative to the stator, the closed position decreasing drilling mud flow from flowing from the plurality of stator channels down-hole creating an increased positive pulse amplitude signal up-hole, and the open position increasing drilling mud flow from the plurality of stator channels through the plurality of rotor channels down-hole creating an increased negative pulse amplitude signal up-hole, for communicating data from at least one down-hole device.

Clause 22. A mud valve system of clause 21, further comprising an inner housing body with a plurality of vent ports formed therein and configured to direct flow of the drilling mud to the stator, and an outer housing body enveloping the inner housing body and forming a flow channel therebetween for directing the drilling mud down-hole.

Clause 23. The mud valve system of clause 22, wherein the open position increases drilling mud flow from the plurality of stator channels through the plurality of rotor channels down-hole through the flow channel creating the increased negative pulse amplitude signal up-hole.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein.

Furthermore, no limitations are intended to the details of construction or design herein shown other than as described in the claims below. It is therefore evident that the particular illustrative embodiments disclosed above may be altered, combined, or modified, and all such variations are considered within the scope of the present disclosure. The systems and methods illustratively disclosed herein may be suitably practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A mud valve system for creating increased pulse amplitude signals in a wellbore, comprising:

an inner housing body with a plurality of vent ports formed therein and configured to direct drilling mud flow to a stator;

an outer housing body enveloping the inner housing body and forming a flow channel therebetween;

the stator having a plurality of stator lobes forming a plurality of stator channels therebetween;

a rotor positioned adjacent the stator and having a plurality of rotor lobes forming a plurality of rotor channels therebetween, the rotor rotatable from a closed position to an open position and from the open position to the closed position relative to the stator, the closed position restricting drilling mud flow from the plurality of stator channels to the plurality of vent ports creating an increased positive pulse amplitude signal up-hole, and the open position increasing drilling mud flow from the plurality of stator channels through the plurality of rotor channels to the plurality of vent ports into the flow channel creating an increased negative pulse amplitude signal up hole, for communicating data from at least one down-hole device, and at least one vent port configured in the outer housing body and is in fluid communication with at least one of the plurality of vent ports in the inner housing.

2. The mud valve system of claim 1, wherein the at least one vent port configured in the outer housing body is in fluid communication with an annulus.

3. The mud valve system of claim 1, wherein the at least one vent port configured in the outer housing body is replaceable.

4. The mud valve system of claim 1, wherein a total amount of stator channels is the same as a total amount of rotor channels.

5. The mud valve system of claim 1, further comprising a drive unit to rotate the rotor.

6. The mud valve system of claim 1, wherein the drive unit is controllable to select a rotation rate of the rotor for selecting a data rate.

7. The mud valve system of claim 1, wherein the mud valve system is operatively connectable to the at least one down-hole device for permitting the at least one down-hole device to communicate up-hole using the mud valve.

8. The mud valve system of claim 1, wherein the increased positive pulse amplitude signal and the increased negative pulse amplitude signal provides for improved detection ability at a receiver up-hole.

9. The mud valve system of claim 1, wherein the flow channel is in fluid connection with each of the plurality of vent ports in the inner housing for conveying drilling mud down-hole.

10. A method for creating increased pulse amplitude signals in a wellbore, comprising:

rotating a rotor in a valve at a desired rate to a first position to restrict flow of drilling mud down-hole, the first position causing an increased positive pulse amplitude signal up-hole for signaling;

rotating a rotor in the valve at a desired rate to a second position to increase drilling mud flow down-hole, the second position causing an increased negative pulse amplitude signal up-hole for signaling, and venting a portion of the drilling fluid into an annulus, while the rotor is in a second position.

11. The method of claim 10, wherein the step of rotating rotates the rotor to the second position permitting a plurality of channels formed in the rotor to align with a plurality of channels formed in a stator within the valve.

12. The method of claim 11, wherein the step of rotating rotates the rotor to the second position increasing drilling mud flow down-hole and into an annulus.

13. The method of claim 10, wherein the step of rotating rotates the rotor to the first position permitting a plurality of lobes formed in the rotor to block flow of the drilling mud from flowing through a plurality of channels formed in the stator.

14. The method of claim 10, further comprising alternating rotating the rotor from the first position to the second position to create a plurality of increased pulse amplitude for communicating up-hole.

15. The method of claim 10, further comprising controlling a rotation rate of the rotor to provide an optimal signal for detection by a detector up-hole.

16. The method of claim 10, wherein the rotating steps generate the increased positive pulse amplitude signal and the increased negative pulse amplitude signal that are detectable up to at least 9000 meters of well depth.

17. The method of claim 10, wherein the first position causes a momentary buildup of pressure detectable up-hole as the increased positive pulse amplitude signal.

18. The method of claim 10, wherein the second position causes a momentary reduction of pressure detectable up-hole as the increased negative pulse amplitude signal.

* * * * *